United States Patent [19]

Kerbs

[11] 4,128,908

[45] Dec. 12, 1978

[54] SLEEPING BAG LINER

[76] Inventor: Reuben Kerbs, 1460 Laurel St., Coos Bay, Oreg. 97420

[21] Appl. No.: 849,307

[22] Filed: Nov. 7, 1977

[51] Int. Cl.[2] ..... A47G 9/00

[52] U.S. Cl. ..... 5/334 C; 5/343

[58] Field of Search ..... 2/69.5; 5/334 R, 334 C, 5/343, 344

[56] References Cited

U.S. PATENT DOCUMENTS

| | | | |
|---|---|---|---|
| 3,175,231 | 3/1965 | Magario et al. | 5/343 |
| 3,178,734 | 4/1965 | Carrez | 5/343 |
| 4,063,319 | 12/1977 | Smith et al. | 5/343 |

*Primary Examiner*—Casmir A. Nunberg

*Attorney, Agent, or Firm*—Kolisch, Hartwell, Dickinson & Stuart

[57] ABSTRACT

A sheet liner for a sleeping bag or the like which can be easily removed from the sleeping bag for washing. The liner is formed from a single sheet which is folded crosswise to form top and bottom panels having a lower fold. The panels are joined along their side edges by seams extending from the lower fold along a major portion of the side edges but terminating short of the upper edge of the top panel. The bottom panel extends beyond the top panel, forming an end margin for a pillow when the liner is inserted into the sleeping bag.

3 Claims, 3 Drawing Figures

SLEEPING BAG LINER

BACKGROUND AND SUMMARY

The following invention relates to bedding articles, and in particular, to detachable sheet liners designed for use with sleeping bags or the like.

There are generally two varieties of sleeping bags—a rectangular, zippered bag having top and bottom quilted panels which open into two joined panels, and a so-called mummy bag providing a substantially single-piece casing that can be opened along a top edge portion. Both types of bags are filled with an insulating thermal material such as down or dacron fill.

One problem associated with both types of sleeping bags is the difficulty in washing such bags. Repeated washing of sleeping bags usually produces an uneven mat of the thermal material, and may even lead to a loss in the insulation properties of the thermal material. Furthermore, the bag, once washed, is difficult to dry thoroughly.

In the past, the problem of keeping a sleeping bag clean has been partially solved by providing a detachable sleeping bag liner which can be removed from the sleeping bag and separately washed. Such liners as have been proposed in the past are generally open sheets designed for attachment to the side edges of a rectangular, zippered sleeping bag, attached either by a zipper or side ribbons. Thus, the sleeping bag must be specially adapted for attachment to such a liner.

The present invention is a sleeping bag liner designed to be nonattachably held in a rectangular, zippered sleeping bag or a mummy bag. The liner has top and bottom panels which are joined along a lower end fold and along their sides by seams which extend from the lower fold along a major portion of the side edges of the panels, these seams terminating short of the upper edge of the top panel. The liner is placed in either of the above-described sleeping bags so that the bottom fold lies along the foot of the bag. The bottom panel has an end panel extending beyond the upper edge of the bag to underlie a pillow and to prevent the liner from being pulled into the bag during use. The loose upper side edges of the two panels facilitate entry into lined sleeping bag.

Accordingly, it is an object of the present invention to provide a sheet liner nonattachably held within a conventional rectangular, zippered sleeping bag or a mummy-type sleeping bag.

It is another object of the present invention to provide such a liner which is easily inserted into and removed from the sleeping bag.

It is yet another object of the invention to provide such a sheet liner which is simple in construction and inexpensive in manufacture.

These and other objects and features of the present invention will now be more fully described with reference to the following detailed description of the invention and the accompanying drawings wherein:

DETAILED DESCRIPTION OF THE INVENTION

Figure 1:
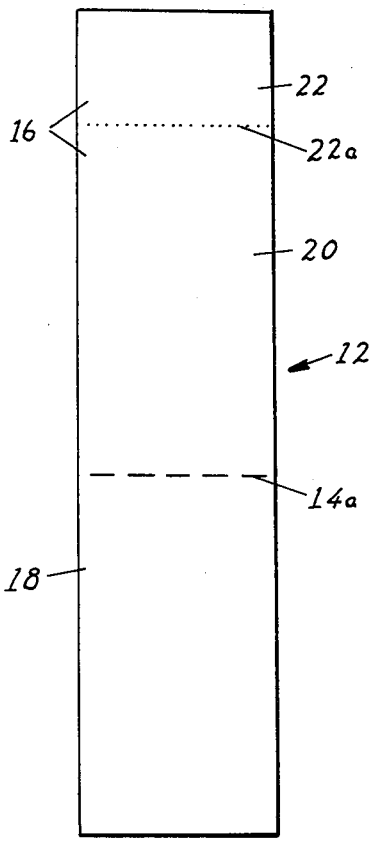
FIG. 1 shows the elongate sheet from which the sheet liner is made.

Referring now to FIG. 1, there is shown an elongate sheet 12 from which the sheet liner of the present invention is formed. Sheet 12 is of conventional sheet material, for example, cotton or muslin, which is durable and easily washable.

The sheet 12 is folded crosswise along a fold line 14*a*located slightly less than half way between the lower and upper edges of the sheet. Folding the sheet along line 14*a*forms a bottom panel 16 and a shorter top panel 18. The bottom panel includes a lower body region 20 having substantially the same length as the top panel and 20 and an upper head region 22. Regions 20 and 22 are distinguished by dotted line 22*a*in FIG. 1.

Figure 2:
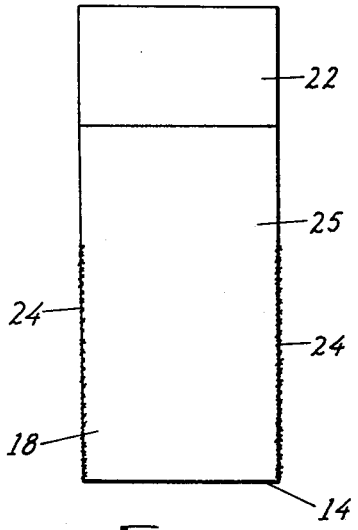
FIG. 2 is a top plan view of the sheet liner.

As seen in FIG. 2, the bottom and top panels are joined at their lower edges by a fold 14 corresponding to the fold line 14. The top panel is coextensive with the body region of the bottom panel, and the upper head region of the bottom panel extends beyond the upper edge of the top panel.

A pair of seams 24 join the top and bottom panels along their opposite edges. The seams extend from the fold 14 along a major portion of the side edges, but terminate short of the upper edge of the top panel. Typically, the top panel is about six feet long and the seams each about 4 feet long. Thus, the unjoined region adjacent the upper edge of the top panel forms a flap 25 approximately two feet long to facilitate entry into the liner.

Figure 3:
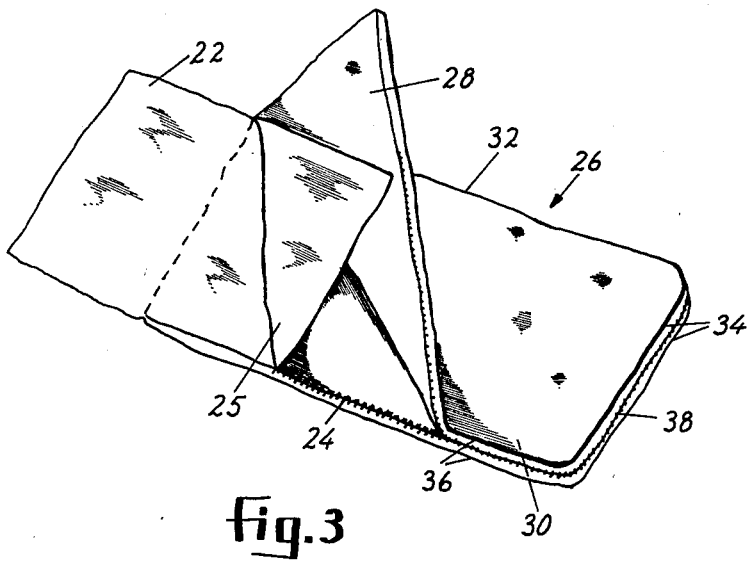
FIG. 3 is a perspective view of the sheet liner within a conventional rectangular, zippered sleeping bag.

The sheet liner of FIG. 2 may be placed in either type of sleeping bag described above. FIG. 3 shows the liner positioned within a rectangular, zippered bag 26. The sleeping bag has a top covering expanse 28 and a bottom underlying expanse 30. The two expanses are joined at one set of side edges by a fold 32, and are joined at their bottom edges 34 and at the other set of side edges 36 by a zipper 38.

The sheet liner is placed in the sleeping bag such that the fold 14 is substantially along the lower edge of the bag. The body region of the liner bottom panel overlies the bottom underlying expanse, and the upper covering expanse overlies the top panel. The head region 22 projects beyond the upper edge of the sleeping bag to underlie a pillow (not shown). Alternatively, the upper head region may be folded under the lower underlying expanse to prevent the liner from being pulled into the bag. Flap 25 is shown folded back to illustrate how the flap facilitates entry into the sheet-lined sleeping bag.

It can be appreciated that the liner is easily inserted into any type of sleeping bag and that the construction of the liner serves to retain the upper and lower sheath panels in a proper upper and lower sheet position within the bag, and further allows for easy entry into the bag.

Although the specific embodiment of the invention as illustrated in FIGS. 1–3 is dimensioned for use in a one-man sleeping bag, a liner suitable for use in a double, or two-man sleeping bag may be similarly constructed from a sheet having approximately twice the width of sheet 12 shown in FIG. 1. It can be appreciated that other variations and modifications may be made without departing from the true spirit of the invention.

It is claimed and desired to protect by letters patent:

1. A sheet liner for a sleeping bag or the like comprising an elongate sheet folded crosswise to form top and bottom panels joined at their lower ends by a fold, said bottom panel having a greater length than said top panel, and seams joining said top and bottom panels along their opposite side edges, said seams extending from said fold along a major portion of said side edges, but terminating short of the upper edge of said top panel.

2. A sheet liner for a sleeping bag or the like comprising an elongate bottom panel having an upper head region and a lower body region, an elongate top panel substantially coextensive with said body region of said lower panel, said top and bottom panels being joined at their lower ends by a fold, and seams joining said top and bottom panels along their opposite side edges, said seams extending from said fold along a major portion of said side edges, but terminating short of the upper edge of said top panel.

3. The combination of a sleeping bag having a top covering expanse and a bottom underlying expanse, said expanses being substantially coextensive and joined along their lower edges and opposite sets of side edges, said bag being detachably joined along at least a portion of one set of side edges adjacent the upper edges of said expanses, and a sheet liner having an elongate bottom panel, said bottom panel having a body region which overlies said bottom underlying expanse and a head region extending beyond the top edge of said bottom expanse; an elongate top panel substantially coextensive with said body region of said lower panel, said top and bottom panels being joined at their lower set of edges by a fold; and seams joining said top and bottom panels along their opposite side edges, said seams extending form said fold along a major portion of said side edges, but terminating short of the upper edge of said top panel.

* * * * *